US007854596B2

(12) United States Patent
Schnetzka et al.

(10) Patent No.: US 7,854,596 B2
(45) Date of Patent: Dec. 21, 2010

(54) SYSTEM AND METHOD OF OPERATION OF MULTIPLE SCREW COMPRESSORS WITH CONTINUOUSLY VARIABLE SPEED TO PROVIDE NOISE CANCELLATION

(75) Inventors: Harold Robert Schnetzka, York, PA (US); E. Curtis Eichelberger, Jr., Harrisburg, PA (US); Paul Nemit, Jr., Roanoke, VA (US)

(73) Assignee: Johnson Controls Technology Company, Holland, MI (US)

( * ) Notice: Subject to any disclaimer, the term of this patent is extended or adjusted under 35 U.S.C. 154(b) by 758 days.

(21) Appl. No.: 11/626,482

(22) Filed: Jan. 24, 2007

(65) Prior Publication Data

US 2008/0175717 A1 Jul. 24, 2008

(51) Int. Cl.
*F04B 41/06* (2006.01)
*F04B 49/20* (2006.01)

(52) U.S. Cl. ..... 417/4; 417/22; 417/42; 417/426; 318/461; 388/911; 62/215

(58) Field of Classification Search ..... 417/2, 417/3, 42, 44.2, 44.11, 426; 388/911; 62/215, 62/226, 228.1; 327/2, 3, 5, 7, 8, 12, 156, 327/157, 158, 159; 318/461
See application file for complete search history.

(56) References Cited

U.S. PATENT DOCUMENTS 3,718,845 A * 2/1973 Bejach et al. ..... 318/78
4,307,324 A * 12/1981 Regnier ..... 388/813
4,526,513 A * 7/1985 Bogel ..... 417/56
5,073,091 A * 12/1991 Burgess et al. ..... 417/222.1
5,221,185 A * 6/1993 Pla et al. ..... 416/34
5,314,312 A * 5/1994 Ikemoto et al. ..... 417/16
5,453,943 A * 9/1995 Magliozzi ..... 700/280
5,499,301 A * 3/1996 Sudo et al. ..... 381/71.3
5,502,770 A 3/1996 Kuo et al.
5,789,678 A * 8/1998 Pla ..... 73/660
6,257,832 B1 * 7/2001 Lyszkowski et al. ..... 417/2
6,428,282 B1 * 8/2002 Langley ..... 417/2
7,282,873 B2 * 10/2007 Abali et al. ..... 318/41
7,387,498 B2 * 6/2008 Schnetzka et al. ..... 417/4
2003/0077187 A1 * 4/2003 Kabasawa et al. ..... 417/322
2003/0175112 A1 * 9/2003 Namiki et al. ..... 415/90
2005/0123407 A1 6/2005 Schnetzka et al.
2005/0237717 A1 * 10/2005 Babb et al. ..... 361/697
2010/0028164 A1 * 2/2010 Matsui ..... 417/2

* cited by examiner

*Primary Examiner*—Devon C Kramer
*Assistant Examiner*—Nathan Zollinger
(74) *Attorney, Agent, or Firm*—McNees Wallace & Nurick, LLC

(57) ABSTRACT

A system for cancelling or attenuating noise in at least two positive displacement compressors proximately located from each other for use with a heating or cooling system. A lead compressor and a lag compressor have a controllable rotational speed and phase of operation. A controller selectably controls the rotational speed and the phase of operation of each of the compressors. The controller controls the rotational speed of the compressors at substantially the same speed for each compressor, with a phase-lock loop and a comparator circuit for each compressor. The controller controls the phase of operation of the compressors through an oscillator so that the lead and lag compressor pressure pulses are spaced between successive outlet pressure pulses to effectively double the combined pulsation frequency for noise attenuation.

27 Claims, 6 Drawing Sheets

SYSTEM AND METHOD OF OPERATION OF MULTIPLE SCREW COMPRESSORS WITH CONTINUOUSLY VARIABLE SPEED TO PROVIDE NOISE CANCELLATION

BACKGROUND

The application generally relates to a method of operation and apparatus for noise attenuation of positive displacement compressors. The application relates more specifically to a method of operation and apparatus for noise attenuation of screw compressors that decreases the peak to peak amplitude and increases the frequency of the composite pressure pulse of the screw compressors by varying the speed of one or more of the screw compressors. The invention accomplishes noise attenuation without the use of an error sensor in the discharge line or through the use of an acoustic sensor thereby reducing the complexity of the noise reduction system. In addition, by reducing the peak-to-peak amplitude and increasing the frequency of the composite pressure pulse the muffler system is reduced in both size and cost.

Heating and cooling systems are typically used to maintain temperature control in a structure. A primary component in such a system is a positive displacement compressor which receives a cool, low-pressure gas and by virtue of a compression device, exhausts a hot, high-pressure gas. One type of positive displacement compressor is a screw compressor, which generally includes two cylindrical rotors mounted on separate shafts inside a hollow, double-barreled casing. The sidewalls of the compressor casing typically form two parallel, overlapping cylinders which house the rotors side-by-side. Screw compressor rotors typically have helically extending lobes and grooves on their outer surfaces forming a large thread on the circumference of the rotor. During operation, the threads of the rotors mesh together, with the lobes on one rotor meshing with the corresponding grooves on the other rotor to form a series of gaps between the rotors. These gaps form a continuous compression chamber that communicates with the compressor inlet opening, or "port," at one end of the casing and a compressor discharge opening or port at the opposite end of the chamber. The gas enters a continuous compression chamber at the inlet port and is continuously reduced in volume as the rotors turn thereby compressing the gas as the gas travels to the discharge port. Once the compressed gas reaches the discharge port it is provided to the rest of the system.

These rotors rotate at high rates of speed, and multiple sets of rotors (compressors) may be configured to work together to further increase the amount of gas that can be circulated in the system, thereby increasing the operating capacity of a system. While the rotors provide a continuous pumping action, each set of rotors (compressor) produces pressure pulses as the pressurized gas is discharged at the discharge port. These discharge pressure pulsations act as significant sources of audible sound within the system.

To eliminate or minimize the undesirable sound, noise attenuation devices or systems can be used. One example of a noise attenuation system is a dissipative or absorptive muffler system typically located at the discharge of the compressor. The use of muffler systems to attenuate sound can be expensive, depending upon the frequencies and peak-to-peak amplitudes that must be attenuated by the muffler system. Typically, the lower the frequency of the sound to be attenuated, and the greater the peak-to-peak amplitude the greater the cost and size of the muffler system.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment relates to a circuit for controlling a rotational speed and a phase of operation of each of at least two compressors. The circuit includes a first phase-lock loop circuit associated with a reference compressor and a second phase-lock loop circuit associated with a second compressor. The second phase-lock loop circuit is interconnected with the first phase-lock loop circuit in a closed feedback loop. The first phase-lock loop circuit is configured to detect a difference between a phase of a first pressure pulse waveform generated by the first compressor and a phase of a second pressure pulse waveform generated by the second phase-lock loop circuit. The first phase-lock loop circuit generates an error signal that is proportional to a detected difference in phase between the first and second pressure pulse waveforms. An analog-to-digital converter is configured to process the error signal for input to a speed controller operatively connected to the second compressor to control the rotational speed of the second compressor to be substantially equal to the rotational speed of the reference compressor, and to control the phase of the second pressure pulse waveform relative to the phase of the first pressure pulse waveform in response to the processed error signal. The speed controller adjusts the phase of the second pressure pulse waveform opposite to the phase of the first pressure pulse waveform.

Preferably, each phase-lock loop circuit includes a pressure transducer connected to a discharge pressure port of an associated compressor and a comparator connected to the pressure transducer. The comparator is arranged to receive a discharge pressure signal from the pressure transducer, compare the discharge pressure signal to a reference voltage, and generate a waveform representative of a pressure pulsation of the associated compressor. A phase detector circuit is arranged to receive the output waveform of the comparator, compare the phase and frequency of the comparator output waveform with a second waveform, and generate a variable output signal responsive to the phase and frequency difference between the compared waveforms. A filter circuit is connected to the output of the phase detector circuit.

The circuit, in a preferred embodiment, may include an oscillator connected to the output filter circuit of the second phase lock loop. The oscillator is configured to generate an oscillator signal that varies in frequency in response to the output signal of the phase detector circuit. A frequency divider circuit is connected to the oscillator to divide by two the frequency of the oscillator signal which ensures the duty cycle presented to the phase detector inputs are at 50%. The divided oscillator signal is connected to a second input of the first PLL phase detector circuit and to a second input of the second PLL phase detector circuit in order to form an output waveform of the second PLL with divide by two circuit that is 180 degrees out of phase and synchronized in frequency with the output of the first PLL comparator circuit.

Another embodiment relates to a system for attenuating noise in at least two positive displacement compressors proximately located from each other for use with at least one heating or cooling system. The system includes at least two positive displacement compressors including a reference compressor. The two compressors have a selectably controllable rotational speed and a selectably controllable phase of operation. A control circuit is provided for controlling a rotational speed and a phase of operation of each of the at least two compressors. The control circuit includes a first phase-lock loop circuit associated with a reference compressor; a second phase-lock loop circuit associated with a second compressor; the second phase-lock loop circuit being interconnected with the first phase-lock loop circuit in a closed feedback loop. The first phase-lock loop circuit is configured to detect a difference between a phase of a pressure pulse waveform generated by the reference compressor and a phase of a pressure pulse waveform generated by the second compressor, and to generate an error signal proportional to a detected difference in phase between the pressure pulse waveforms. A means for processing the error signal for input to a speed controller connected to the second compressor is also provided, to control the rotational speed and phase of operation of the second compressor, to control the rotational speed of the second compressor at substantially the same rotational speed as the reference compressor, and to shift the phase of operation of the second compressor so that an outlet pressure pulse operatively produced by the second compressor is substantially evenly spaced between successive outlet pulses operatively produced by the reference compressor.

Another embodiment relates to method for attenuating noise in two positive displacement compressors proximately located from each other having a reference compressor for providing reference operational settings for comparison with the remaining compressors of the at least two compressors for use with at least one heating or cooling system. The method includes the steps of sensing, for each compressor, a pressure pulse waveform representative of a rotational speed and phase of operation of the associated compressor; varying a frequency of a feedback signal in proportion to the rotational speed and phase of operation of the second compressor; dividing the frequency of the feedback signal by two; inverting the divided feedback signal to shift a phase of the pressure pulse waveform by 180 degrees; applying the inverted and shifted feedback signal into a phase detector of a reference compressor; and generating a speed control signal to control the speed and phase of operation of the second compressor in response to a detected difference in phase between the second compressor and the reference compressor, such that a waveform of the second compressor pressure pulse is interleaved with a pressure pulse waveform of the reference compressor to form a composite pressure pulse waveform of the reference compressor and second compressor having about double the frequency of the individual reference and second compressor pressure pulse waveforms.

Another embodiment relates to a circuit for controlling a rotational speed and a phase of operation of each of a plurality of positive displacement compressors. The circuit includes a first phase-lock loop circuit associated with a reference compressor having a phase detector circuit. The phase detector circuit has a first input for connecting to a reference compressor pulsation signal, a reference input connected in a closed feedback loop, and an output. The first phase-lock loop circuit output is connected to an oscillator through a filter, and a divider circuit connected to the oscillator. The first phase lock loop circuit is configured to synchronize the first input with the reference input and to generate a timing signal. A delay circuit is driven by the timing signal. The delay circuit is configured to generate at least one reference signal. Each reference signal is phase-delayed in a predetermined increment based on the timing signal. At least one lagging phase-lock loop circuit is provided. Each lagging phase-lock loop circuit us associated with a lag compressor that is mechanically interconnected with the reference compressor. Each lagging phase-lock loop circuit includes a first input connected to one of the phase-delayed reference signals, a second input connected to a pulsation signal of the associated lag compressor, and an output filter circuit. Each lagging phase-lock loop circuit is configured to generate a speed control signal to the associated lag compressor, to shift a phase of a pressure pulse of the lag compressor, to interleave the reference compressor and each lag compressor pressure pulsations, thereby increasing a frequency of an aggregate pressure pulsation of the mechanically interconnected reference and lag compressors.

Alternative exemplary embodiments relate to other features and combinations of features as may be generally recited in the claims.

BRIEF DESCRIPTION OF THE FIGURES

The application will become more fully understood from the following detailed description, taken in conjunction with the accompanying figures, wherein like reference numerals refer to like elements, in which.

Wherever possible, the same reference numbers will be used throughout the drawings to refer to the same or like parts.

DETAILED DESCRIPTION OF THE EXEMPLARY EMBODIMENTS

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
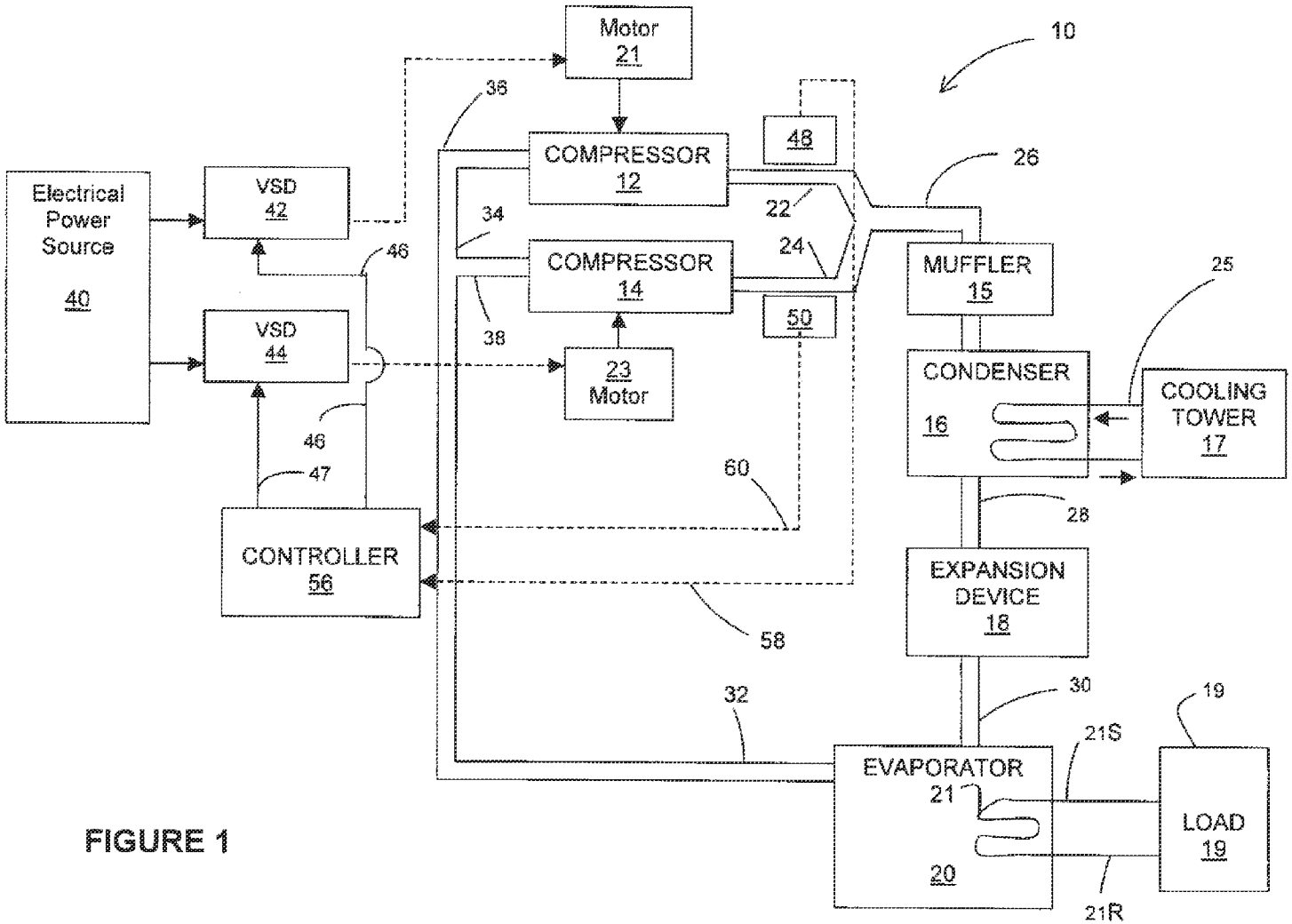
FIG. 1 is a schematic of a continuously variable speed compressor system of the present invention as applied to a two compressor system.

One embodiment of a heating, ventilation, air conditioning or refrigeration (HVAC&R) system 10 of the present invention is depicted in FIG. 1. A positive displacement lead compressor 12 is connected to a motor 21 and variable speed drive 42, for selectively controlling operational parameters, such as rotational speed, of the compressor 12. Compressor 12 discharges compressed refrigerant gas through discharge line 22. Similarly, compressor 14, which operates in parallel with compressor 12, discharges compressed refrigerant gas through discharge line 24. These compressors are typically positive displacement compressors, such as screw, reciprocating or scroll, having a wide range of cooling capacities. Sensors 48, 50 monitor the instantaneous refrigerant gas discharge pressure passing through respective discharge lines 22, 24 to provide parameter inputs to a controller 56 via respective lines 58, 60. The controller 56 includes logic devices, such as a microprocessor or other electronic means, for the generation of speed control signals for controlling the operating parameters of compressors 12, 14 by controlling their respective variable speed drives 42, 44 via respective lines 46, 47 and the speed of their respective motors 21, 23. AC electrical power received from an electrical power source 40 is rectified from AC to DC, and then inverted from DC back to variable frequency AC by variable speed drives 42, 44 for driving respective compressor motors 21, 23. The compressor motors are typically AC induction, but might also be Brushless Permanent Magnet, Switched Reluctance or other motors that can be operated in a variable speed mode. After refrigerant gas that is compressed by compressors 12, 14 is directed downstream of sensors 48, 50, discharge lines 22, 24 join and become a common line 26. Muffler 15 is positioned along the common line 26 to dissipate or absorb the composite pressure pulses generated by operation of the compressors 12, 14.

Common line 26 delivers refrigerant gas to the condenser 16, which enters into a heat exchange relationship with a fluid, typically water, flowing through a heat-exchanger coil 25 connected to a cooling tower 17. Alternately, the condenser 16 can reject the heat directly into the atmosphere through the use of air movement across a series of finned surfaces (air cooled condenser). The refrigerant vapor in the condenser 16 undergoes a phase change to a refrigerant liquid as a result of the heat exchange relationship with the liquid in the heat-exchanger coil 25. The condensed liquid refrigerant from condenser 16 flows along a conduit 28 to an expansion device 18, which greatly lowers the temperature and pressure of the refrigerant before entering the evaporator 20 via conduit 30.

The evaporator 20 can include a heat-exchanger coil 21 having a supply line 21S and a return line 21R connected to a cooling load 19. The heat-exchanger coil 21 can include a plurality of tube bundles within the evaporator 20. Water or any other suitable secondary refrigerant, e.g., ethylene glycol, calcium chloride brine or sodium chloride brine, travels into the evaporator 20 via supply line 21S and exits the evaporator 20 via return line 21R. The liquid refrigerant in the evaporator 20 enters into a heat exchange relationship with the fluid in the heat-exchanger coil 21 to lower the temperature of the fluid in the heat-exchanger coil 21. The refrigerant liquid in the evaporator 20 undergoes a phase change to a refrigerant gas as a result of the heat exchange relationship with the fluid in the heat-exchanger coil 21. The gas refrigerant in the evaporator 20 then returns to the compressors 12, 14 by suction line 32 which bifurcates at suction plenum 34 to separate suction lines 36, 38 which join respective compressors 12, 14 to complete the cycle. In another embodiment of the present invention, the suction line 32 from the evaporator 20 to the compressors 12, 14 can be continuously separate lines that deliver refrigerant gas to the compressors 12, 14.

Figure 5:
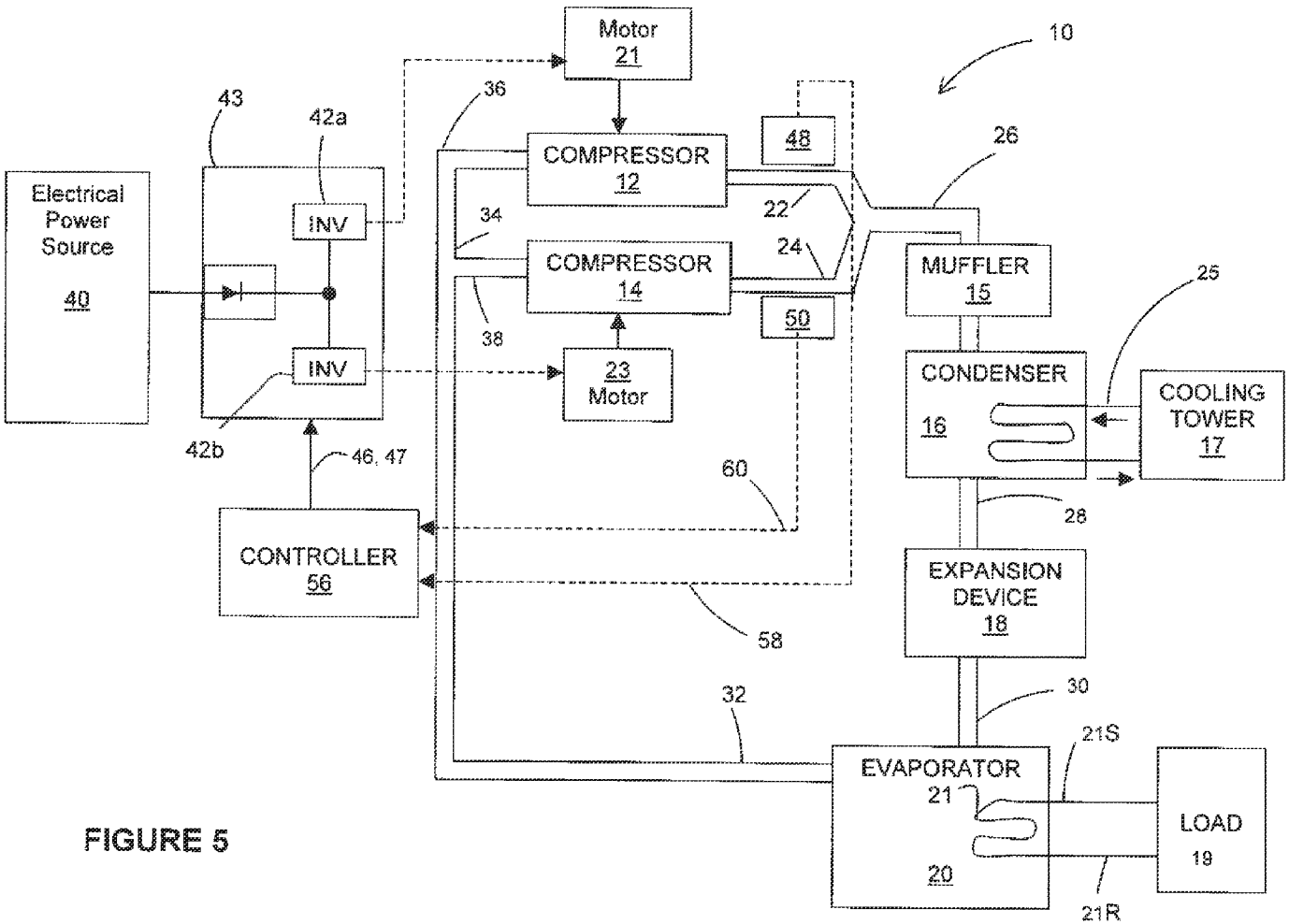
FIG. 5 is a schematic of a continuously variable speed compressor system of the present invention having a multiple-inverter and single converter variable speed drive as applied to a two compressor system.

Variable speed drives 42, 44 collectively provide variable speed control to the operating parameters of respective compressors 12, 14 by independently controlling both the frequency and voltage magnitude of electrical power to the motors 21, 23 by power source 40. Collectively, variable speed drives 42, 44 can simultaneously vary both the frequency and voltage, as dictated by the controller 56 via respective speed control signals, to provide control of the overall system refrigeration capacity through the use of variable speed modulation of compressors 12, 14. Alternately, variable speed drives 42, 44 may be combined into a single variable speed drive, containing a single AC to DC converter and two or more DC to AC inverters to provide a lower cost solution as is shown in FIG. 5. While the system of the present invention illustrates two variable speed drives for selectively controlling two compressors, so long as each compressor is controlled by a separately designated variable speed drive, it is envisioned that any number of compressors may be employed.

Variable speed drive 42 controls the operating parameters applied to the motor of lead compressor 12 via speed control signal provided on line 46. The remaining compressors in the system are referred to as lag compressors. Selection of lead compressor 12 is not critical as it is not dependent on size, but is for identifying an operating point of reference for the controller 56. Thus, the compressors used in system 10 are not required to be of the same capacity.

Controller 56, which controls the operations of system 10, employs continuous feedback from the average outputs of discharge pressure sensors 48, 50 to continuously monitor and change the frequency and voltage applied to compressors 12, 14 in response to changes in system cooling loads. That is, as the system 10 requires either additional or reduced cooling capacity, which is constantly monitored by the controller 56, the operating parameters of any of the compressors 12, 14 in the system 10 may likewise be revised. To maintain maximum operating efficiency, the operating frequencies of the compressors 12, 14 are changing constantly, such as proportionally changing the operating frequencies of all the compressors as controlled by a capacity control algorithm within the controller 56. However, separate from system load requirements, the controller 56 also continuously monitors the instantaneous gas parameter readings provided by discharge pressure sensors 48, 50 to minimize the composite compressor sound level in the system.

One way for the controller 56 to effect noise attenuation in system 10 is to control the phase of operation of the compressor 14 with respect to compressor 12. The controller 56 monitors the occurrence of pressure pulses from the lead or reference compressor 12 by use of sensor 48. From this information, the controller 56 varies the magnitude of speed control signal provided on line 47 to variable speed drive 44 to synchronize the feedback pressure pulses emanating from the lag compressor 14 via sensor 50 with respect to frequency and phase, simultaneously interleaving the pulsations sensed by sensor 50 with respect to the pressure pulsations sensed by sensor 48. This shifting preferably produces a resultant or effective output wave that is twice the frequency of waveform A (see FIG. 4) having a wavelength half that of waveform A. This shifting also produces an effective output pressure waveform at common line 26 that has a lower peak to peak amplitude than either of the pressure waveforms present at the individual discharge lines 22 and 24. Higher frequency and lower peak-to-peak amplitude waves are easier to attenuate, requiring smaller, less expensive dissipating or absorption mufflers.

In an alternate embodiment, additional lag compressors may be employed. By placing additional lag compressor waves in the system which are substantially equally spaced between successive pulses of the lead compressor, the resultant wave frequency is multiplied by the total number of compressors. Preferably, two to four compressors are employed in this arrangement. Therefore, if there are four compressors, whose pulse pattern is shifted in accordance with the present invention, the resultant pulse wave frequency is multiplied by four, although any number of compressors may be used in a system.

Variable speed drives 42, 44 are jointly controlled by the controller 56 such that each variable speed drive 42, 44 provide AC power in steady state operation at the same desired voltage and frequency to corresponding motors 21, 23.

Preferably, the controller 56 can provide control signals to the variable speed drives 42, 44 to control the operation of the variable speed drives 42, 44 to provide the optimal operational setting for the respective motors 21, 23 depending on the particular sensor readings received by the controller 56. For example, in the refrigeration system 10, the controller 56 can adjust the output voltage and frequency from the variable speed drives 42, 44 to correspond to changing conditions in the refrigeration system 10, i.e., the controller 56 can increase or decrease the output voltage and frequency of the variable speed drives 42, 44 in response to increasing or decreasing load conditions on the respective compressors 12, 14 in order to obtain a desired operating speed of the motors 21, 23 and a desired capacity of the compressors 12, 14.

Figure 2:
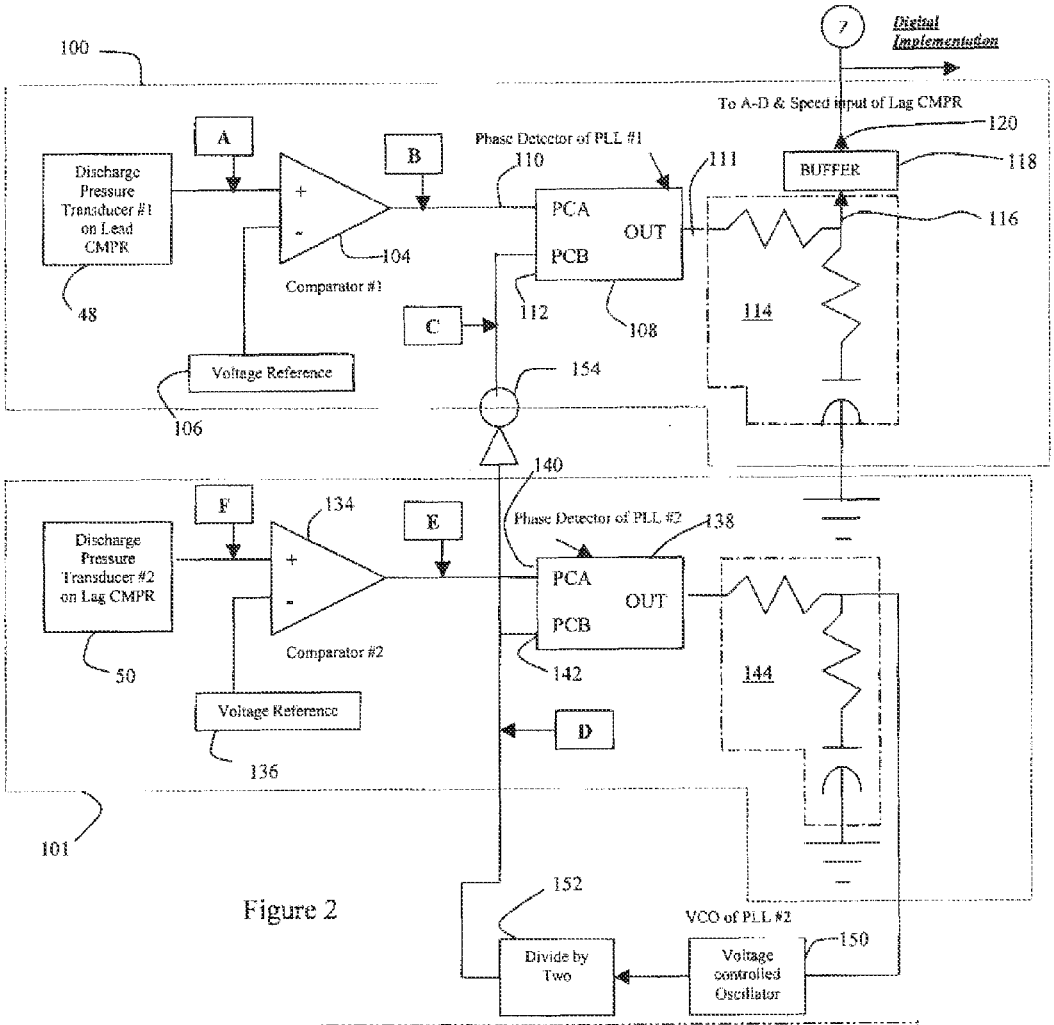
FIG. 2 is a schematic diagram of the phase-lock loop control circuitry of the present invention as applied to a two compressor system.
Figure 3:
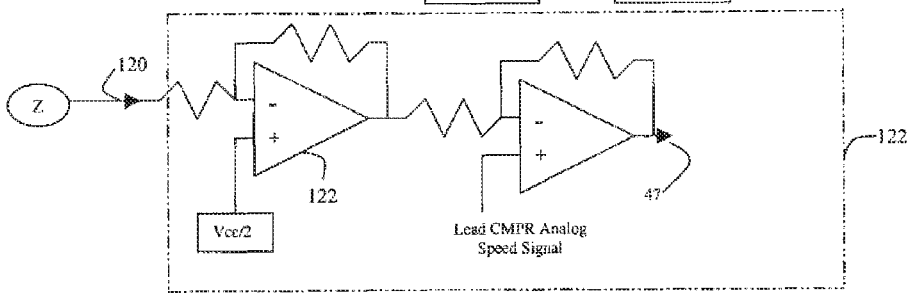
FIG. 3 is a schematic diagram of an exemplary analog circuit for generating an analog speed command signal for the second compressor as applied to a two compressor system.
Figure 4:
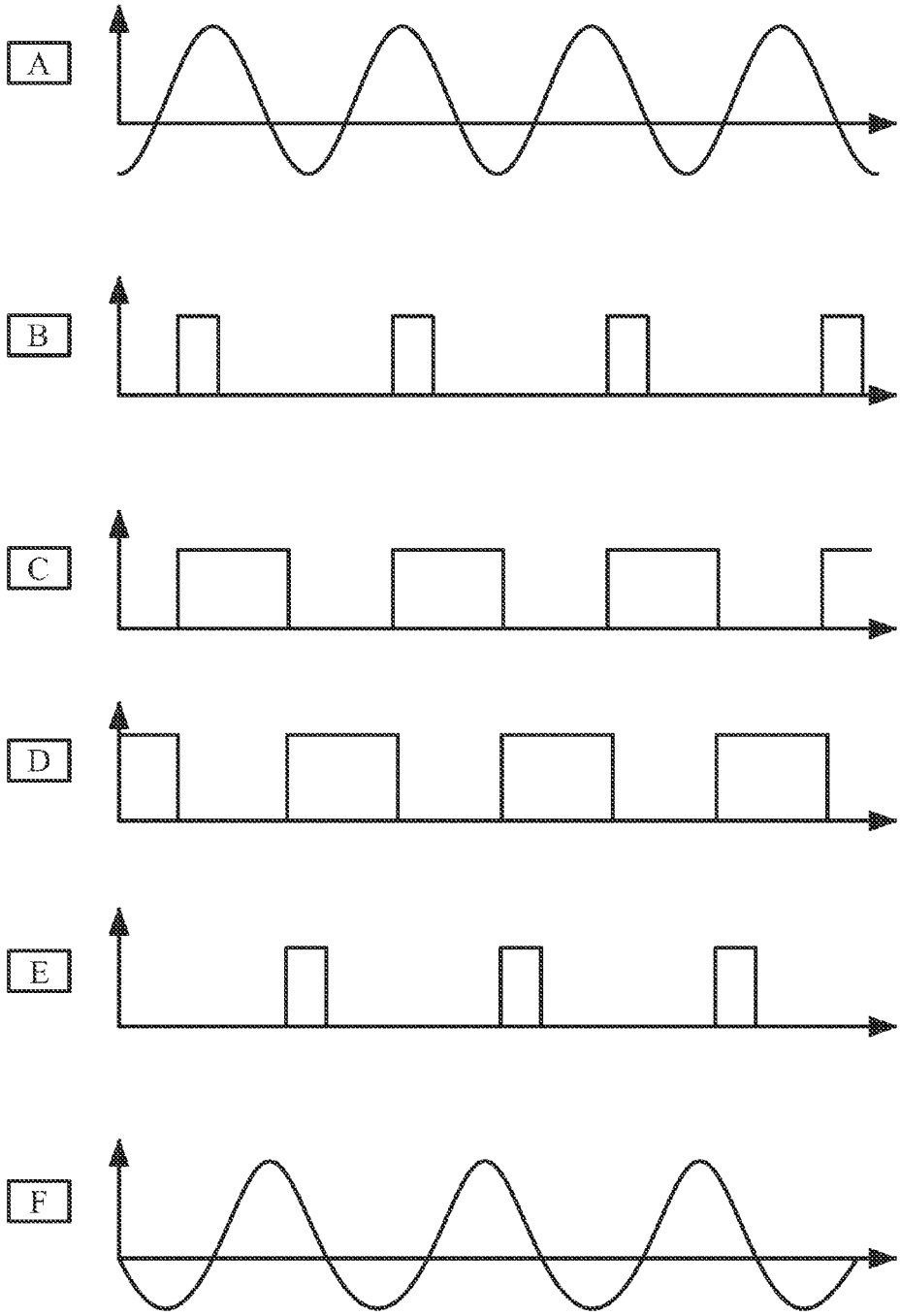
FIG. 4 is a graphic representation of the waveforms generated by the control circuitry of FIG. 2.

Referring next to FIGS. 2-4, in one implementation of the present invention, the system includes a first phase lock-loop circuit 100 and a second phase-lock loop circuit 101. The phase lock-loop circuit 100 has a discharge pressure transducer 48 applied to the discharge line of the reference compressor 12. The speed of compressor 12 is determined by the controller 56 via a reference speed control signal that is responsive to increasing or decreasing load conditions in the refrigerant system. The output signal A of discharge pressure transducer 48 is shown as waveform A in FIG. 4.

The output signal A of pressure transducer 48 is applied to a comparator 104. The comparator 104 compares the output signal A with a voltage reference signal 106, and generates a binary output. The comparator 104 generates a "1" in response to output signal A being greater in magnitude than the voltage reference signal 106. The comparator 104 generates a "0" in response to the output signal A being equal or lesser in magnitude than the voltage reference signal 106. The voltage reference signal 106 is preselected such as to eliminate pressure pulsations from the lag compressor 14 from being inadvertently detected by the comparator 104. The pressure pulsation from compressor 14 is smaller in magnitude than the pressure pulsation of the reference compressor 12, due to the relative physical proximities of the two compressors 12, 14, and the discharge line lengths used to connect the compressors. The output of the comparator 104 for the reference compressor 12 is shown as waveform B in FIG. 4. The output of comparator 104 is applied to phase detector 108 as the reference waveform for the first PLL 100, by applying the output signal B to the PCA input 110 of phase detector 108. Phase detector 108 has two signal inputs PCA 110 and PCB 112. Phase detector 108 acts as a state machine providing for three possible output states: (1) the output is set to a digital "1" and equal to the DC power supply voltage ($V_{cc}$) provided to the detector for the time period when PCA is a digital "1" and PCB is a digital "0"; (2) the output is set to an open circuit or high impedance for the time period when the digital levels seen by PCA and PCB are the same i.e.—both are digital "1" or both are digital "0"; (3) the output is set to a digital "0" and equal to the common of the DC power supply voltage provided to the detector for the time period when PCA is a digital "0" and PCB is a digital "1". By providing for this digital state machine operation, when operating in a closed loop fashion, Phase Detector 108 maintains 0° of phase shift between the feedback signal on PCB 112 and the reference input signal on PCA 110. In addition, through the use of feedback control means the frequency of the digital feedback signal PCB is forced to lock onto the frequency of digital reference signal PCA. The resultant feedback signal seen on input PCB 112 is indicated as waveform C in FIG. 4. Waveform C is the inverted feedback signal from the second Phase-lock loop 138, and is locked in frequency and is locked 180 degrees out of phase with the signal representative of the pressure pulsations detected from the lag compressor, which is processed as discussed below. The output error signal 111 of Phase Detector 108 is passed through a lag-lead filter circuit 114. The lag-lead filter circuit 114 is preferred over a simple low pass filter because it provides a faster response time and alleviates phase jitter between the PCA and PCB input signals to phase detector 108. The output error signal 116 of the lag-lead filter circuit 114 is then applied to a buffer circuit 118. Buffer circuit 118 alleviates any loading effects on the filter network. The buffered output error signal 120 is then applied to Analog to Digital (A-D) converter 122 for processing for use with a digital based controller.

The A-D converter processes this error signal 120 and generates the "speed" command signal 47 for compressor 14, increasing the operating speed of the compressor 14 when the input error signal 120 to the A-D converter 122 increases, and conversely, decreasing the operating speed of the compressor 14 when the input error signal 120 to the A-D converter 122 decreases. Increasing and/or decreasing the operating speed of compressor 14 causes the pressure pulsations in compressor 14, detected by discharge pressure sensor 50, to be related in both phase and frequency with the pressure pulsations in compressor 12, detected by discharge pressure sensor 48, resulting in the interleaving of the pressure pulsations of compressor 14 within the pressure pulsations of compressor 12.

Referring to FIG. 3, in an alternate embodiment, where a digital based controller is not used to control the speed of compressor 14, FIG. 3 represents a means to eliminate the A-D conversion process if a microprocessor is not employed to generate the speed control signal. It shows implementation of an analog circuit to generate the speed control signal 47 for the lag compressor, thus providing an alternative to providing an A-D converter.

Referring again to FIG. 2, a discharge pressure transducer 50, is applied to the discharge line of the lag compressor 14. The output signal F from discharge pressure transducer 50 is shown as waveform F in FIG. 4. Signal F is fed into a second comparator 134, and is compared with a voltage reference signal 136. The reference voltage signal 136 may be the same as that of voltage reference signal 106, or it may differ depending on the physical location of the discharge pressure transducers 50, 48 relative to the compressors 14, 12. The comparator 134 compares the output signal F with a voltage reference signal 136, and generates a binary output. The comparator 134 generates a "1" in response to output signal F being greater in magnitude than the voltage reference signal 136. The comparator 134 generates a "0" in response to the output signal F being equal or lesser in magnitude than the voltage reference signal 136. Similar to the comparator circuit 104 above, the voltage reference signal 136 is preselected such as to eliminate pressure pulsations from the lead compressor 12 from being inadvertently detected by the comparator 134. The pressure pulsation from compressor 12 is smaller in magnitude than the pressure pulsation of the lag compressor 14, due to the relative physical proximities of the two compressors 12, 14, and the discharge line lengths used to connect the compressors.

The comparator 134 generates a "1" in response to output signal F being greater in magnitude than the voltage reference signal 136 to provide a digital waveform shown in FIG. 4 as waveform E. Signal E is input to the reference input PCA 140 of phase detector 138. The output of phase detector 138 is connected to a lead-lag filter circuit 144. The filtered output is then input to voltage controlled oscillator (VCO) 150, and the output of the VCO is applied to a divider circuit 152 that divides the frequency of the VCO output signal by two. The divider circuit serves to supply a 50% duty cycle waveform at the input to the PCB inputs of phase detector circuits 108 and 138. The output of the divide by two circuit 152 is shown as Signal D in FIG. 4. Signal D is applied to inverter 154 and inverted to produce Signal C as shown in FIG. 4. The non-inverted Signal D is applied to reference input PCB 142, to produce the interleaving of compressor 14's pressure pulsations with the pressure pulsations of compressor 12.

Thus, by the use of the Phase Detector 108 in PLL 100, the waveform C is synchronized in phase, with the positive edge, and thereby also the frequency, of waveform B. Waveform D is the inversion of waveform C, and is therefor shifted out of phase by 180 degrees. Through the use of a second Phase Detector 138 and the closed loop including VCO 150 and divide by two circuit 152, waveform D is synchronized to waveform E by phase with the positive edge, and thereby also by frequency. The result of the above-described interconnection between the two phase-locked loops is to shift the pressure pulsations of compressor 14 180 degrees out of phase with the pressure pulsations of compressor 12. This results in an effective pressure pulsation frequency of double the single compressor.

In a preferred embodiment, the present invention implements phase-detectors 108, 138, using a phase-lock loop device such as the PLL MC14046 manufactured by Motorola Corporation, of Arlington Heights, Ill., or similar PLL devices, which provide a Phase Detector function and a Voltage Controlled Oscillator (VCO) function. The advantage of the PLL MC14046 is that it includes both a phase detector and a VCO required to implement the present invention. However, it will be appreciated by those skilled in the art that the invention may be practiced by assembling individual components, such as phase detector devices and voltage controlled oscillators, to arrive at the same or equivalent circuitry shown in FIG. 2.

The phase detector 108, 138 is a digital device. Each phase detector operates like a pair of series-connected electronic switches (not shown) connected between the control circuit voltage Vcc and ground. The center connection of the two switches is the output of the phase detector. When the two input signals on PCA and PCB of the Phase Detector 108, 138, are exactly in synchronization in regards to their respective negative to positive signal transitions, both of the electronic switches are open. When the positive edge of the signal on PCA leads the positive edge of signal on PCB in time, the upper switch turns on at the positive transition of PCA, generating an output of $V_{cc}$ until the positive transition of PCB occurs. Alternately, if PCA's positive transition lags PCB's positive transition, the lower switch is turned on at the positive transition of PCB, generating an output of zero until the positive transition of PCA occurs.

The analog low-pass filter networks are not as responsive to speed correction as are the lead-lag filter circuits 114, 144, as discussed above. However, the analog low-pass filter networks are alternate configurations for the output of phase detectors 108,138 in a PLL application. Each low-pass filter averages the output voltage of the phase detector, prior to the voltage being applied to the buffer 118, in the case of phase detector 108, and to the VCO 150, in the case of phase detector 138.

The Voltage Controlled Oscillator (VCO) 150 is an oscillator. The output frequency of the VCO 150 is controlled by the analog input signal to the VCO 150. When the input is zero volts, the VCO 150 generates a minimum frequency output waveform in an approximate square wave configuration. Conversely, when the input of the VCO output voltage is Vcc, the oscillator generates a maximum frequency output waveform. The minimum VCO output frequency and the maximum VCO output frequency, corresponding to the zero and Vcc voltage levels, are determined by the values of two resistors and a capacitor (not shown). The VCO 150 is ideally a linear device, and generates an output signal representing ½ of its frequency range when one half of the control voltage [Vcc]/2 is applied to its input The output waveform D of VCO 150 is applied back to PCB input 142 of phase detector 138 to form a closed-loop network. When the loop is thus closed, the output frequency of the VCO increases, and then decreases, by way of the input signal to the VCO 150—the average output voltage of the preceding Phase Detector—until the input signals on PCA and PCB are locked in both phase and frequency. The phases are synchronized with respect to the positive rising edge. A change in either phase or frequency of the reference signal—PCA—results in an associated adjustment to the average input voltage to the VCO until input signals on PCA and PCB are again locked in both phase and frequency. The divide by two circuit 152, divides the frequency of the input signal by two to provide an output signal having one half the frequency and at 50% duty cycle. The divide by two circuit 152 is inserted into the feedback loop at the output of the VCO 150. The resultant frequency of the VCO 150 will be twice the reference (PCA) frequency, and again locked in time with the reference signal PCA.

In an alternate embodiment shown in FIG. 3, the analog voltage generated by Phase Detector 108 is amplified or attenuated and summed with the speed command being sent to the reference compressor 12. The analog output of the first phase detector 108 acts as a "trimming" signal for a reference speed signal sent to govern the speed of compressor 14. This circuit configuration may be used in lieu of the A-D converter and associated digital implementation described above.

The compressor speed and phase may be similarly controlled if both compressors 12, 14 are connected to individual inverter sections 42*a*, 42*b* of a common variable speed drive 43 (See, e.g., FIG. 5). Both positive displacement compressors should be of equal compression rates for optimum noise cancellation.

In order to achieve sound cancellation in the refrigeration system 10, the compressors 12, 14 must utilize a common discharge line and operate at the same compression ratio, Also, the wavelength of sound propagating in the discharge gas must be greater than four times the internal diameter of the discharge piping or the cavity that joins them, a condition commonly known as plane waves.

Dynamic pressure sensors 48, 50 are secured along the discharge line(s) 22, and 24 of each compressor 12, 14 to sense the instantaneous pressure pulsations in the refrigerant fluid flowing through the discharge lines 22 and 24. The speed and phase of the compressors 12, 14 are interleaved based on the sensed pressure pulsations. The VSDs 42, 44 preferably employ voltage boost capability along with a frequency boost, permitting compressor speeds exceeding 3,000/3,600 RPM, which is typically associated with a conventional 50/60 Hz electrical power source, to efficiently respond to an increased cooling load 19 on the refrigeration system 10. Alternately, the VSDs 42, 44 permit compressor speeds below 3,000/3,600 RPM by lowering the frequency to the compressors to efficiently respond to a decreased cooling load 19 on the refrigeration system 10. VSDs having voltage boost and frequency boost capability are described in U.S. Patent Application Publication No. 20050189888 A1, published Sep. 1, 2005, entitled "VARIABLE SPEED DRIVE FOR MULTIPLE LOADS", which is incorporated by reference herein.

Figure 6:
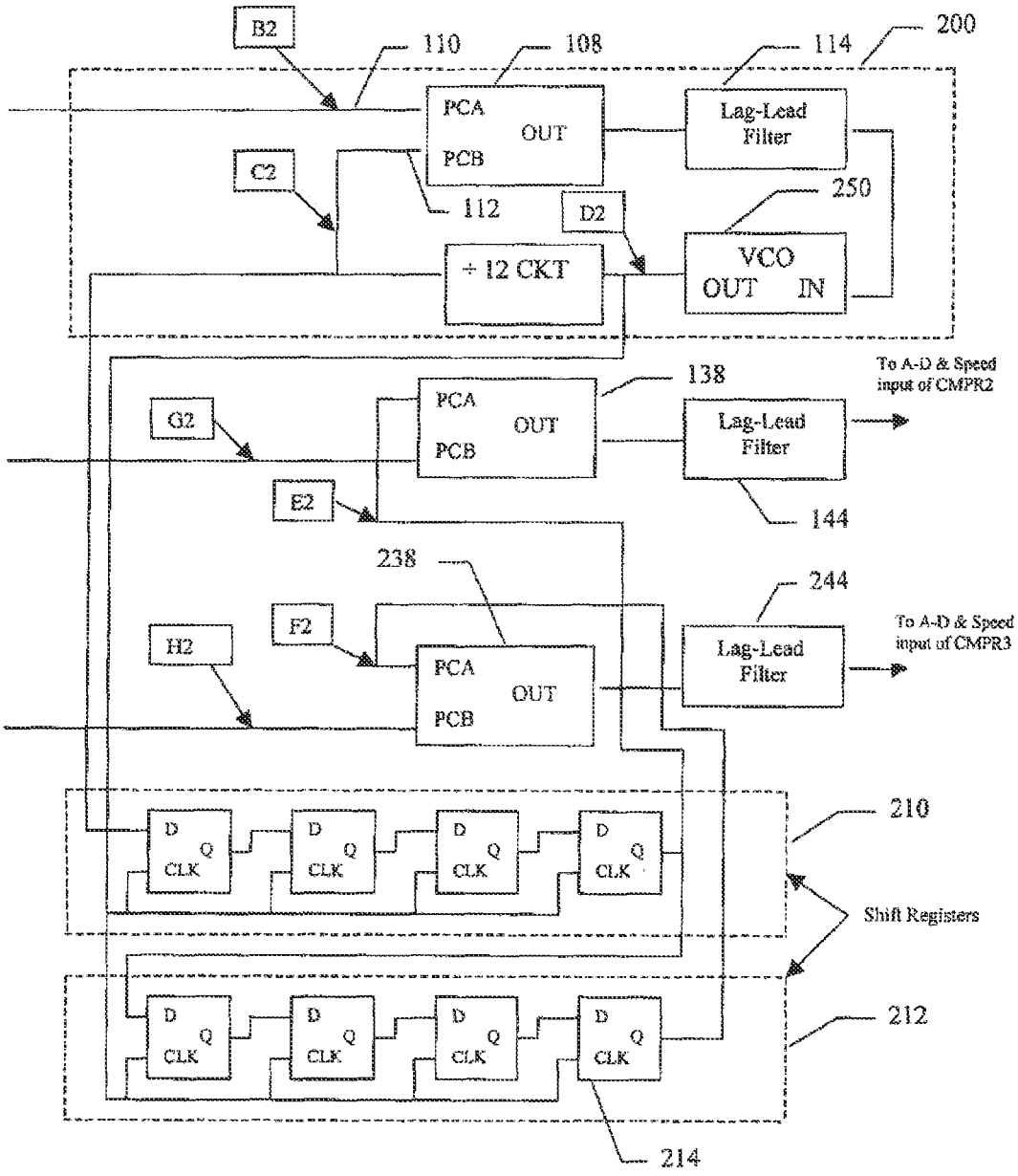
FIG. 6 is a schematic diagram of the phase-lock loop control circuit of the present invention as applied to a three compressor system.
Figure 7:
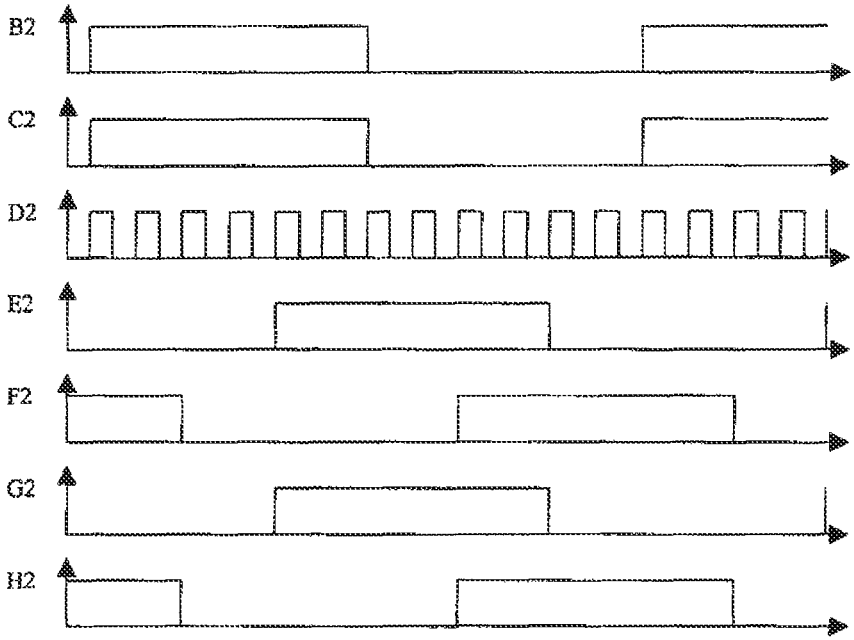
FIG. 7 is a graphic representation of the waveforms generated by the control circuitry of FIG. 6.

While the above description is directed to a pair of compressors—lead compressor 12 and lag compressor 14—this basic circuit form can be modified, to provide pressure pulsation interleaving for any number of compressors, effectively multiplying the resultant frequency seen at the common discharge line by "n" times, where "n" is the number of compressors used in the system. For example, FIG. 6, shows a modified version of the circuit in FIG. 2, adapted for a three-compressor circuit by closing a first PLL feedback loop circuit 200 around the reference or lead compressor 48. The lead compressor 48 in the three-compressor configuration includes a lag-lead filter circuit 114, VCO 250 and divide-by-twelve circuit in the feedback loop. This generates a VCO output frequency of twelve times the lead compressor pressure pulsation rate B2. FIG. 7 shows the various waveforms B2-H2, indicating the relative phase relationships of the signals at designated points in the circuit. The positive edge of the VCO 250 output waveform D2 is synchronized to the PCA input's positive edge by utilizing a positive edge triggered divide by twelve circuit. The PCB input waveform C2 is generated by the divide by twelve circuit. The PCB input waveform C2 is then phase delayed via shift registers 210, 212 to yield digitally delayed waveforms E2 and F2. Each of the individual flip-flops 214 of shift registers 210, 212 provide a 30° phase delay. The output signal D2 of the VCO 250 is applied to the clock input (CLK) for the shift registers 210, 212. The outputs of the shift registers 210, 212 are waveforms E2 and F2, which are digitally delayed at 120° and 240°, respectively, with respect to waveform C2. The outputs of the shift registers 210, 212 respectively, are applied as references to two additional phase detectors 138, 238. Alternately, the output of the reference VCO 250 may be applied to digital logic circuits (not shown) to generate two phase-displaced square waves E2, F2. Each waveform is displaced by 120° in phase from the other two waveforms. These two reference waveforms provide the PCA inputs to the two additional phase detector circuits 138, 238 that are associated with the lag compressors. Discharge pressure transducers and comparators associated with the two lag compressors (not shown) provide the PCB inputs to the two phase detector circuits 138, 238. The outputs of each of the phase detector circuits 138, 238, are connected to respective A-to-D converters (not shown) after processing by the lead lag filters, 144, 244, for further processing and generation of the speed control signals for the two lag compressors.

It will be appreciated by those skilled in the art that the multiple compressor circuit configurations described above may be extended to virtually any number of compressors, by adjusting the phase angles so as to interleave the pulses, and the corresponding waveforms, approximately equally, using various delay configurations such as the shift registers or equivalent delay elements in conjunction with the phase lock loop circuits.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the multiple compressor control circuits and system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

What is claimed is:

1. A circuit for controlling a rotational speed and a phase of operation of each of at least two compressors, comprising:

a first phase-lock loop circuit associated with a reference compressor;

a second phase-lock loop circuit associated with a second compressor;

the second phase-lock loop circuit being interconnected with the first phase-lock loop circuit in a closed feedback loop;

wherein the first phase-lock loop circuit is configured to detect a difference between a phase of a first pressure pulse waveform generated by the first phase-lock loop circuit and a phase of a second pressure pulse waveform generated by the second phase-lock loop circuit, and to generate an error signal proportional to a detected difference in phase between the first and second pressure pulse waveforms; and an analog-to-digital converter configured to process the error signal for input to a speed controller operatively connected to the second compressor to control the rotational speed of the second compressor to be substantially equal to the rotational speed of the reference compressor, and to control the phase of the second pressure pulse waveform relative to the phase of the first pressure pulse waveform in response to the processed error signal;

wherein the speed controller adjusts the phase of the second pressure pulse waveform opposite to the phase of the first pressure pulse waveform.

2. The circuit of claim 1, wherein each phase-lock loop circuit of said first and second phase-lock loop circuits comprises:

a pressure transducer connected to a discharge pressure port of an associated compressor;

a comparator connected to the pressure transducer, the comparator being arranged to receive a discharge pressure signal from the pressure transducer, to compare the discharge pressure signal to a reference voltage, and to generate an output waveform representative of a pressure pulsation of the associated compressor;

a phase detector circuit arranged to receive the output waveform of the comparator, to compare the phase of the comparator output waveform with a second waveform, and to generate a variable output signal responsive to the phase difference between the comparator output waveform and the second waveform; and a filter circuit connected to an output of the phase detector circuit.

3. The circuit of claim 2, also including:

an oscillator connected to the filter circuit of the second phase-lock loop circuit comparator, the oscillator being configured to generate an oscillator signal that varies in frequency in response to the variable output signal of the phase detector circuit;

a frequency divider circuit connected to the oscillator to divide by two the frequency of the oscillator signal; and wherein the frequency divider circuit is connected to a second input of the second phase-lock loop phase detector circuit and inverted and connected to a second input of the first phase-lock loop phase detector circuit, thereby forming an output waveform of the second phase-lock loop phase detector circuit that is synchronized in frequency and approximately 180 degrees out of phase with the output of the first phase-lock loop circuit comparator.

4. The circuit of claim 3, wherein the oscillator is a Voltage Controlled Oscillator (VCO) having a variable output frequency, the variable output frequency being defined in a range between a predetermined minimum frequency and a predetermined maximum frequency, wherein the variable output frequency of the VCO is controlled by the voltage of the output signal of the phase detector circuit of the second phase-lock loop.

5. The circuit of claim 4, wherein the predetermined minimum frequency of the VCO is the output frequency when output is about zero volts and the predetermined maximum frequency of the VCO is the output frequency when output is maximum control voltage.

6. The circuit of claim 4, wherein the VCO is linear.

7. The circuit of claim 5, wherein the output signal of the VCO is provided as a back reference second waveform input to the second phase-lock loop circuit, the output frequency of the VCO varies as the input signal to the VCO, until a first input signal and a second input signal of the phase detector circuit are locked in both phase and frequency.

8. The circuit of claim 1, wherein the speed controller is configured to generate a signal to increase the operating speed of the second compressor in response to the error signal to the analog-to-digital converter increasing, and to decrease the operating speed of the second compressor in response to the input signal to the analog-to-digital converter decreasing.

9. The circuit of claim 1, wherein each phase-lock loop circuit of said first and second phase-lock loop circuits comprises:

a pressure transducer connected to a discharge pressure port of an associated compressor, a comparator connected to the pressure transducer, the comparator being arranged to receive a discharge pressure signal from the pressure transducer, to compare the discharge pressure signal to a reference voltage, and to generate an output waveform representative of a pressure pulsation of the associated compressor;

a phase detector circuit arranged to receive the output waveform of the comparator, to compare the phase of the comparator output waveform with a second waveform, and to generate a variable output signal responsive to the phase difference between the compared waveforms;

a filter circuit connected to an output of the phase detector circuit;

an oscillator connected to the output filter circuit of the second phase lock loop circuit, the oscillator being configured to generate an output oscillator signal that varies in frequency in response to the output signal of the phase detector circuit;

a frequency divider circuit connected to the oscillator to divide the frequency of the output oscillator signal received from the oscillator; and an inverter connected to the frequency divider circuit to invert a divided oscillator signal, wherein the inverter is connected to the first phase-lock loop circuit phase detector circuit second waveform input to form a closed-loop, such that the inverted waveform output of the second phase-lock loop circuit is synchronized in phase and frequency with the first phase-lock loop circuit comparator output waveform, causing the reference compressor and the second compressor to be phase-shifted by 180 degrees and to rotate at the same frequency.

10. The circuit of claim 9, wherein the oscillator is a Voltage Controlled Oscillator (VCO) having a variable output frequency, the variable output frequency being defined in a range between a predetermined minimum frequency and a predetermined maximum frequency, wherein the variable output frequency of the VCO is controlled by the voltage of the output signal of the phase detector circuit.

11. The circuit of claim 9, wherein the filter circuit is a lag-lead filter circuit.

12. The circuit of claim 9, wherein the filter circuit is a simple low pass filter.

13. The circuit of claim 9, also including a buffer circuit connected to the first phase-lock loop circuit to buffer the error signal for input to the analog-to-digital converter.

14. The circuit of claim 10, wherein the circuit includes at least three phase-lock loop circuits configured to control the speed of at least three compressors to interleave pressure pulsations from at least three compressors by multiplying a resultant pulsation pulse frequency of the at least three compressors, the pulsation pulse frequency being measured at a common pressurized line, by "n" times, where "n" is the number of compressors used in the system.

15. The circuit of claim 1, wherein the speed controller for the second compressor is a variable frequency drive.

16. The circuit of claim 15, wherein the first compressor is controlled by a variable frequency drive.

17. The circuit of claim 1, wherein the speed controller is configured with a single converter DC-link connected to a plurality of inverters, each inverter being operatively associated with an individual one of the first and second compressors, and each inverter independently controllable to vary an output frequency for adjusting the speed of the first and second compressors.

18. The circuit of claim 1 wherein a composite pressure pulse frequency is produced that is higher than a frequency between successive outlet pulses of the reference compressor.

19. A system for attenuating noise in at least two positive displacement compressors proximately located from each other for use with at least one heating or cooling system comprising:

at least two positive displacement compressors, the at least two compressors including a reference compressor, the at least two compressors having a selectably controllable rotational speed and a selectably controllable phase of operation; and a control circuit for controlling a rotational speed and a phase of operation of each of the at least two compressors, the control circuit including:

a first phase-lock loop circuit associated with a reference compressor;

a second phase-lock loop circuit associated with a second compressor;

the second phase-lock loop circuit being interconnected with the first phase-lock loop circuit in a closed feedback loop;

wherein the first phase-lock loop circuit is configured to detect a difference between a phase of a pressure pulse waveform generated by the reference compressor and a phase of a pressure pulse waveform generated by the second compressor, and to generate an error signal proportional to a detected difference in phase between the pressure pulse waveforms; and a controller configured to process the error signal for input to a speed controller connected to the second compressor, to control the rotational speed and phase of operation of the second compressor, to control the rotational speed of the second compressor at substantially the same rotational speed as the reference compressor, and to shift the phase of operation of the second compressor so that an outlet pressure pulse operatively produced by the second compressor is substantially evenly spaced between successive outlet pulses operatively produced by the reference compressor.

20. The system of claim 19, wherein each phase-lock loop circuit of said first and second phase-lock loop circuits comprises:

a pressure transducer connected to a discharge pressure port of an associated compressor, a comparator connected to the pressure transducer, the comparator being arranged to receive a discharge pressure signal from the pressure transducer, to compare the discharge pressure signal to a reference voltage, and to generate a waveform representative of a pressure pulsation of the associated compressor;

a phase detector circuit arranged to receive the waveform of the comparator, to compare a phase of the comparator waveform with a second waveform, and to generate a variable output signal responsive to the phase difference between the comparator waveform and the second waveform; and a filter circuit connected to an output of the phase detector circuit.

21. The system of claim 20, also including:

an oscillator connected to the filter circuit of the second phase-lock loop circuit, the oscillator being configured to generate an output signal that varies in frequency in response to the variable output signal of the phase detector circuit;

a frequency divider circuit connected to the oscillator to divide a frequency of the output signal received from the oscillator;

an inverter connected to the frequency divider circuit to invert an output signal of the frequency divider circuit; and wherein the inverter is connected to the first phase-lock loop circuit phase detector circuit second waveform input to form a closed-loop, such that an inverted waveform output of the second phase-lock loop circuit is synchronized in phase and frequency with the first phase-lock loop circuit comparator waveform, causing the reference compressor and the second compressor to be phase-shifted by 180 degrees and to rotate at the same frequency.

22. The system of claim 21, wherein the speed controller is a variable speed drive.

23. A circuit for controlling a rotational speed and a phase of operation of each of a plurality of positive displacement compressors, comprising:

a first phase-lock loop circuit associated with a reference compressor, the first phase-lock loop circuit having a phase detector circuit, the phase detector circuit including a first input for connecting to a reference compressor discharge pressure sensor to receive a reference compressor pulsation signal, a reference input connected in a closed feedback loop, and an output; the first phase-lock loop circuit output connected to an oscillator through a filter, and a divider circuit connected to the oscillator, first phase-lock loop circuit configured to synchronize the first input with the reference input and to generate a timing signal;

a delay circuit driven by the timing signal, the delay circuit being configured to generate at least one reference signal, each reference signal being phase-delayed in a predetermined increment based on the timing signal;

at least one lagging phase-lock loop circuit, each lagging phase-lock loop circuit associated with a lag compressor that is mechanically interconnected with the reference compressor, each lagging phase-lock loop circuit including a first input connected to one of the phase-delayed reference signals, a second input connected to a lag compressor discharge pressure sensor to receive a pulsation signal of the associated lag compressor and an output filter circuit:

wherein each lagging phase-lock loop circuit is configured to generate a speed control signal to the associated lag compressor to shift a phase of a pressure pulse of the lag compressor, to interleave the reference compressor and each lag compressor pressure pulsations, thereby increasing a frequency of an aggregate pressure pulsation of the mechanically interconnected reference and lag compressors.

24. The circuit of claim 23, wherein the speed control signal is generated by an analog-to-digital (A-D) converter, the A-D converter configured to process at least one phase-delayed reference signal for input to a speed controller operatively connected to the at least one lag compressor to control the rotational speed of the lag compressor to be substantially equal to the rotational speed of the reference compressor, and to control the phase of the lag compressor pressure pulse waveform relative to the phase of the first pressure pulse waveform in response to the processed phase-delayed reference signal.

25. The circuit of claim 23, wherein the speed controller adjusts the phase of the reference compressor pressure pulse waveform and each lag compressor pressure pulse waveform to be approximately symmetrically distributed.

26. The circuit of claim 23, wherein the delay circuit comprises at least one shift register, each shift register including a plurality of series-connected flip-flop circuits, wherein the flip-flop circuits configured to generate symmetrically distributed reference signals for interleaving the pressure pulsations of the reference compressor and lag compressor.

27. The circuit of claim 24, wherein each analog-to-digital converter is connected in series between the filter and a speed control input of the associated lag compressor for processing the speed control signal by a digital speed controller.

* * * * *